United States Patent [19]

Norton

[11] Patent Number: 4,738,148

[45] Date of Patent: Apr. 19, 1988

[54] STARTER DRIVE

[76] Inventor: Peter Norton, 170 Beaver Brook, Lincoln Park, N.J. 07035

[21] Appl. No.: 15,582

[22] Filed: Feb. 17, 1987

Related U.S. Application Data

[63] Continuation of Ser. No. 680,894, Dec. 12, 1984, abandoned.

[51] Int. Cl.[4] ..... F02N 15/06

[52] U.S. Cl. ..... 74/7 R; 74/9; 290/38 R; 318/376

[58] Field of Search ..... 74/6, 7 R, 9; 318/375, 318/376; 290/38 R

[56] References Cited

U.S. PATENT DOCUMENTS

| | | | |
|---|---|---|---|
| 1,829,624 | 10/1931 | Abell | 74/9 |
| 2,342,632 | 2/1944 | Hood | 74/7 R X |
| 2,863,320 | 12/1958 | Mendenhall | 74/6 |
| 2,926,265 | 2/1960 | Isley et al. | 74/7 R X |
| 3,090,242 | 5/1963 | Sabatini | 74/7 R |
| 3,399,575 | 9/1968 | Seilly et al. | 74/7 R |
| 3,572,133 | 3/1971 | Glometti | 74/7 R |
| 3,868,858 | 3/1975 | Reichardt et al. | 74/7 R |
| 3,875,805 | 4/1975 | Toulier | 74/7 R |
| 4,308,462 | 12/1981 | McMillen | 290/38 R |

*Primary Examiner*—Allan D. Herrmann

*Attorney, Agent, or Firm*—Reising, Ethington, Barnard, Perry & Milton

[57] ABSTRACT

A starter drive is disclosed for a starting system of an internal combustion engine. A pinion is rotatably mounted on the starter motor shaft for engagement with the ring gear on the fly wheel of the engine. A drive sleeve disposed coaxially of the shaft is coupled with the pinion through an overrunning clutch. A helical cam and follower are connected between the shaft and the drive sleeve for advancing and retracting the pinion according to the relative speeds of the drive sleeve and the shaft. A friction brake is provided for the drive sleeve to restrain it against rotation during advancing movement of the starter drive. The starter motor has a permanent magnet field and the armature is connected across an electromagnet by the starter switch when it is turned off to provide dynamic braking for the motor. The electromagnet coacts with the permanent magnet brake to disable the friction brake while the motor is slowing down.

29 Claims, 3 Drawing Sheets

10
12
13
14
15
16
18
22
23
24
25
26
27
28
32
33
34
38
42
44
46
48
52
62
64
66
72
74
76
77
78
82
84
86
88
92
2
3

18
62
64
24
44
36
38
46
26
34
48
42
74
42
46
33
76
32
84
84
82
88
16
72
92
88
86
88
84
42
24
74
86
14
32

STARTER DRIVE

This application is a continuation of application Ser. No. 680,894, filed Dec. 12, 1984, now abandoned.

FIELD OF THE INVENTION

This invention relates to a starter system for an internal combustion engine. More particularly, it relates to a starter drive, i.e. the drive unit for coupling the starter motor with the starting ring gear of the engine.

BACKGROUND OF THE INVENTION

In current starter systems for automotive vehicle engines, a solenoid and a mechanical linkage are employed to move the starter pinion into engagement with the ring gear and to close switch contacts to energize the starter motor. A spring is used to disengage the pinion and open the switch contacts when the solenoid is deenergized. Spiral flutes on the shaft of the starting motor cause the inertial and load torque to aid the engagement when the motor is energized and to aid disengagement when it is deenergized.

At an earlier time, a somewhat different starter system was commonly used in automobiles. In this system, there was no solenoid and the engagement and disengagement of the pinion and ring gear was effected solely as the result of inertial and load torque cooperating in conjunction with spiral flutes on the starter shaft. The difficulty with this system is that it has a tendency to disengage when the engine overruns the starter motor. By the addition of the solenoid, as in the abovementioned starter system, the gears are held in engagement for as long as power is applied to the starter motor.

Another arrangement has been proposed to retain the pinion and ring gear in engagement when the engine momentarily overruns the starter motor, without the use of a holding solenoid. In this, a centrifugal detent device retains the starter drive in its advanced or gear engaging position even though there is a momentary overrunning by the engine. Such an arrangement is shown in the Sabatini U.S. Pat. No. 3,090,242 and in the McMillen U.S. Pat. No. 4,308,462.

In order to ensure that the helical cam arrangement provides positive advance of the starter drive, it has been proposed to provide braking means for restraining the starter drive against rotation until the pinion reaches engagement with the ring gear. Reliance upon inertial forces alone to produce the relative angular displacement required has been found to be unsatisfactory. Additionally, braking of the starter drive against rotation also aids in meshing of the pinion with the ring gear without clash. An electromagnetic brake arrangement for the starter drive during its advance toward gear engagement in which the electromagnet travels with the starter drive is shown in the Giometti U.S. Pat. No. 3,572,133. Another electromagnetic brake arrangement in which stationary electromagnets coact with the pinion is described in the Isley et al U.S. Pat. No. 2,926,265.

It is desirable, especially with a starter drive having a centrifugal detent, to provide for braking of the starter motor when it is deenergized to aid in the retraction of the pinion. The is especially important at high motor speed where the latching force of the detent is so great that the forces resulting from deceleration are insufficient to force the detent to release. With braking of the motor, the motor speed is reduced in a fraction of a second to a point where the detent will release. Dynamic braking of a starter motor with a permanent magnet field is disclosed in the McMillen U.S. Pat. No. 4,308,462.

In starter drives of the type having a brake for restraining rotation thereof during advancing movement toward pinion engagement, there is a problem of avoiding or delaying brake engagement during retraction of the pinion which would cause it to be advanced again after the engine is started. Also, it is desirable to provide a biasing force to maintain the starter drive in its retracted position to avoid clash of the pinion with the ring gear due to vibrations and accelerations in the normal operation of the vehicle.

A general object of this invention is to provide an improved starter drive which overcomes certain disadvantages of the prior art.

SUMMARY OF THE INVENTION

In accordance with this invention, a starter drive is provided with braking means for restraining rotation thereof during advancing movement of the pinion gear toward engagement and disabling means for preventing engagement of the braking means while the starter motor is slowing. Further, the braking means comprises a permanent magnet and the disabling means comprises an electromagnet for retracting the permanent magnet.

Further, in accordance with the invention, the electromagnet is connected across the motor armature when the motor is turned off to thereby dynamically brake the motor and provide energization of the electromagnet during rotation of the motor. Preferably, the motor has a permanent magnet field.

Further, according to the invention, a permanent magnet brake is provided with a suspension means which permits axial motion but prevents rotation of the brake. More particularly, the suspension means comprises a plurality of flat spring fingers with one end of each finger being connected with a fixed support member and the other end of each finger being connected with the permanent magnet brake.

Further, according to the invention, the starter drive is provided with stop means for limiting the retracting movement thereof to a position in which the retracted permanent magnet brake is out of engagement with the starter drive. Preferably, the starter drive comprises a drive sleeve with a helical slot and a drive pin carried by the starter shaft and extending into the slot. A roller on the pin minimizes friction. A centrifugally actuated latch means retains the starter drive in its advanced position. Preferably, the latch means comprises a detent carrier rotatable with the shaft and a reciprocable detent element therein which coacts with an opening in the drive sleeve when the starter drive is in its advanced position for latching engagement of the sleeve and the detent element.

A more complete understanding of this invention may be obtained from the detailed description that follows taken with the accompanying drawings.

BEST MODE FOR CARRYING OUT THE INVENTION

Figures 1, 3, 3A:
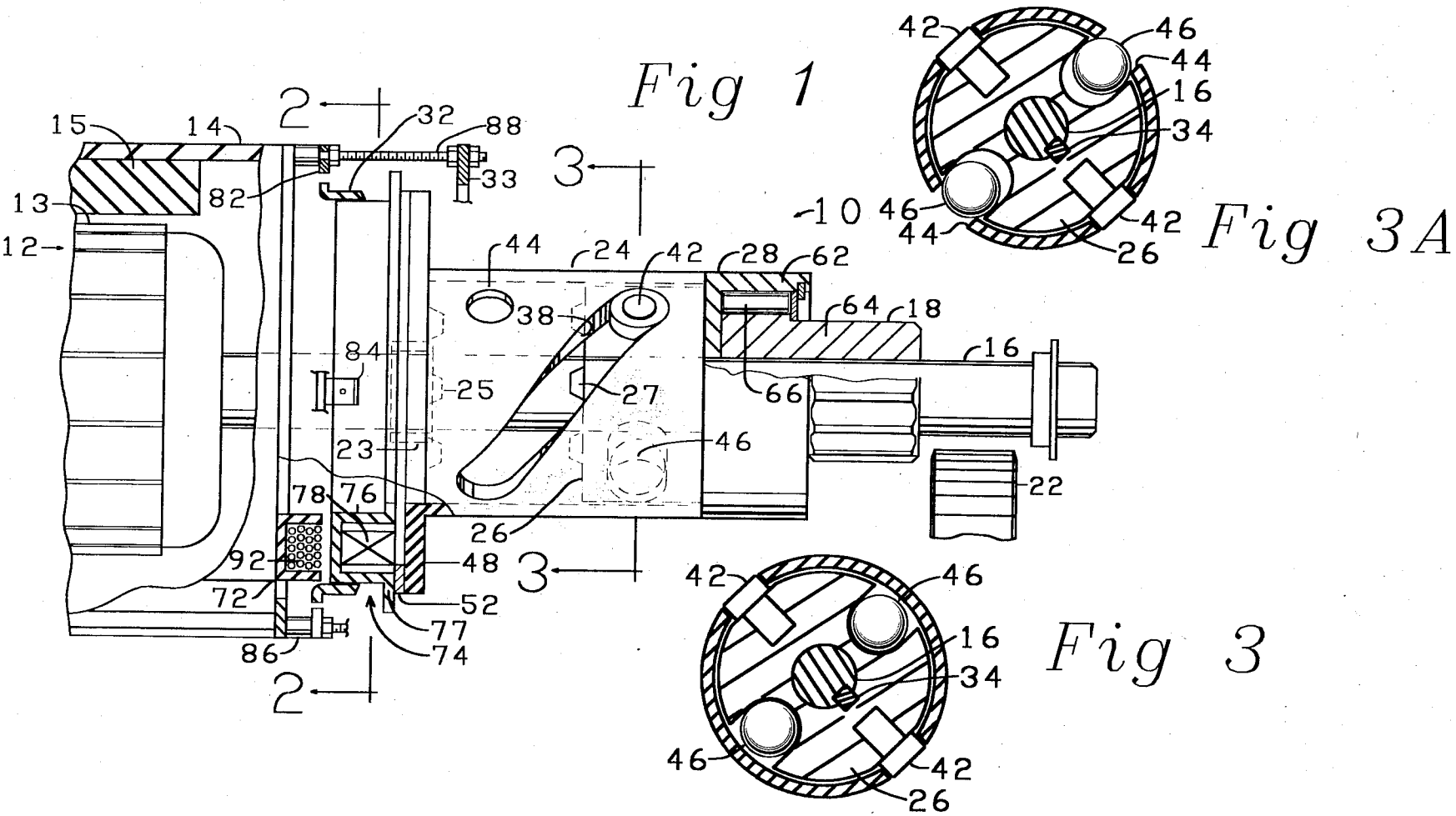
FIG. 1 is an elevation view of the starter drive of this invention in its normal retracted position.
FIG. 3 is a view taken on line 3—3 of FIG. 1.
FIG. 3A shows the view of FIG. 3 with the parts in an alternate position.

Referring now to the drawings, there is shown an illustrative embodiment of the invention for use in a starter system for an internal combustion engine of an automobile. It will be appreciated as the description proceeds, that the invention may be utilized in other embodiments and applications.

Figure 2:
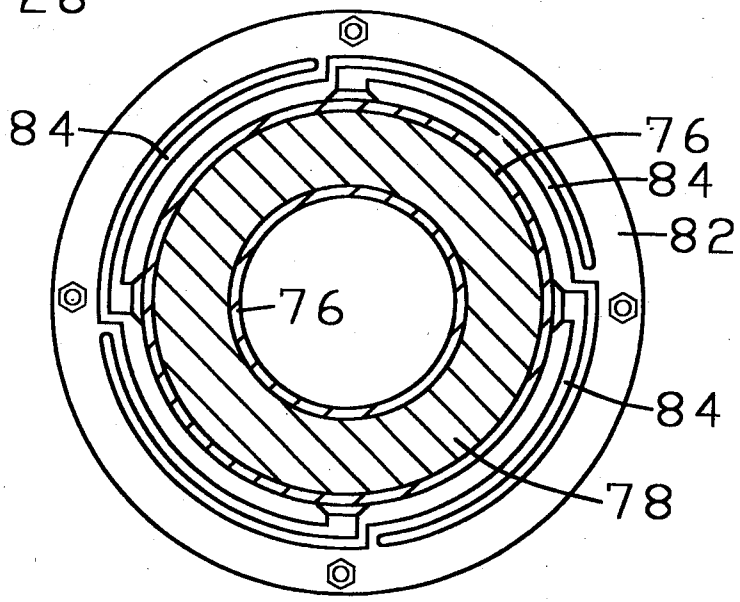
FIG. 2 is a view taken on line 2—2 of FIG. 1.

FIGS. 1, 2 and 3 show a starter system which includes the starter drive 10 of this invention in its normal retracted position. The starter system comprises a starter motor 12 which is mounted in a starter housing 14 and has an armature 13 and a permanent magnet field member 15. A motor shaft 16 carries the starter drive 10. The starter drive 10 is adapted to connect the starter motor 12 with the starting ring gear of the engine. More specifically, the connection is made by engagement of a pinion 18 of the drive 10 with a ring gear 22 on the flywheel of the engine. The drive 10 functions to advance the pinion 18 into engagement with the ring gear 22 in response to energization of the starter motor 12 and to retract the pinion after the engine has been started. The starter motor 12 is preferably a DC motor with a permanent magnet field, a type known for use in automobile starters. This type of motor is preferred because it is especially well adapted for dynamic braking which is utilized in this invention, as will be discussed subsequently.

Figures 4, 6:
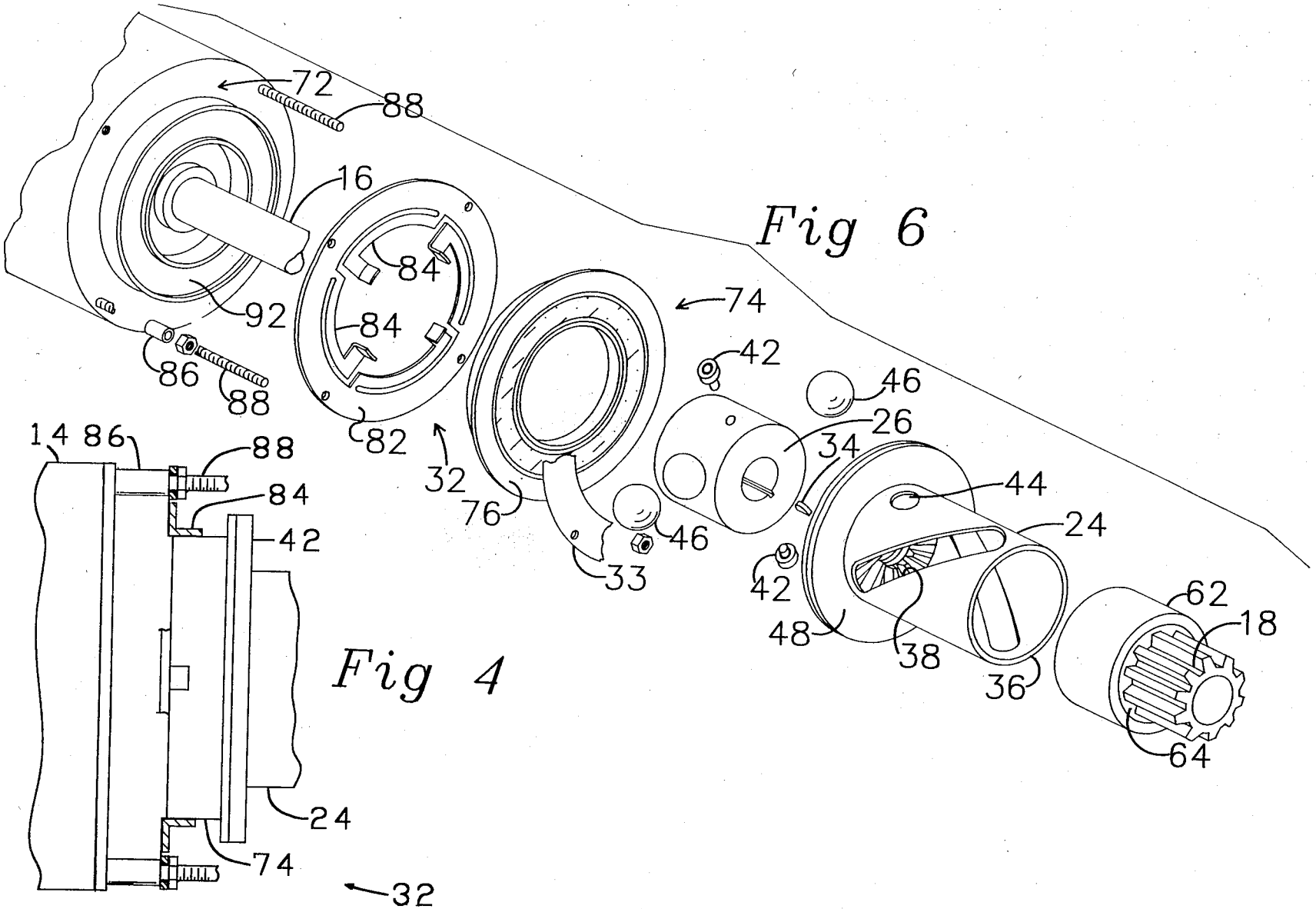
FIG. 4 is a fragmentary view showing the starter drive in its normal retracted position.
FIG. 6 is an exploded view of the starter drive.
Figure 5:
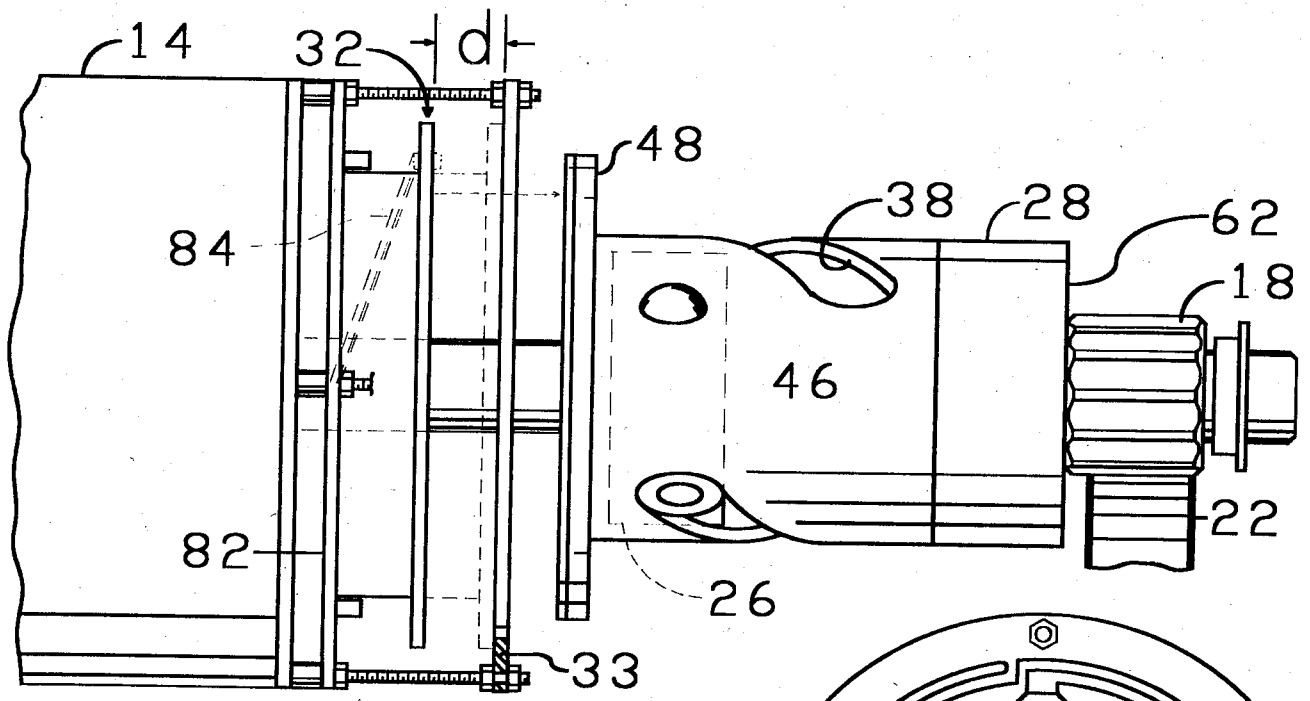
FIG. 5 is an elevation view showing the starter drive in its advanced position.

The starter drive 10 of this invention will now be described with particular reference to FIGS. 1, 2 and 3 which show it in its retracted position and with reference to FIG. 6 which shows it in an exploded view. The starter drive 10 comprises, in general, a drive sleeve 24 which is mounted for reciprocation in an axial direction on overrunning clutch 28 which, in turn, is mounted on the shaft 16. The sleeve 24 is also supported by shaft 16 through bearing 23. The pinion 18 is coupled with the drive sleeve 24 by an overrunning clutch 28. A brake 32 coacts with the drive sleeve 24 to restrain it against rotation during advancing movement of the drive sleeve while leaving it entirely free to rotate during retracting movement, as will be discussed subsequently.

The starter drive 10 will now be described in greater detail. The carrier 26 is an annular body mounted on the shaft 16 for rotation therewith by a key 34. The drive sleeve 24 is a cylindrical member disposed coaxially of the shaft 16 and the carrier 26. The drive sleeve 24 is provided with a pair of oppositely disposed helical cam slots 38 in the wall thereof which respectively receive roller cams 42 which are mounted on the carrier 26. The roller cams 42 transmit driving torque from the motor shaft 16 to the drive sleeve 24. When the rotative speed of the shaft 16 is greater than that of the drive sleeve 24 the roller cams 42 coact with the slot 38 to advance the starter drive outwardly of the shaft to engage the pinion 18 with the ring gear 22, as will be discussed in greater detail subsequently. When the rotative speed of the drive sleeve 24 is greater than that of the shaft 16, the roller cams 42 and slots 38 coact to retract the drive sleeve 24 to the position shown in FIG. 1.

In order to reduce the stress applied to the roller cams 42 when the pinion 18 drivingly engages the ring gear 22 an auxiliary torque transmitting coupling may be provided. For this purpose, the annular flange 48 on the drive sleeve 24 extends inwardly of the sleeve and carries a face gear 25. Also, the carrier 26 is provided at its rear end with a face gear 27 which is adapted to mesh with the gear 25 when the drive sleeve 24 is in its advanced position.

As shown in FIG. 1, the drive sleeve 24 is provided with a pair of circular recesses or openings 44 in the wall thereof at diametrically opposite locations. The carrier 26, as shown in FIG. 3, is provided with a pair of recesses at diametrically opposite locations which carry a pair of detent elements or balls 46, respectively. When the shaft 16 is rotating, the balls 46 are thrown outwardly by centrifugal force. When the sleeve 24 is advanced to a position in which the pinion 18 and ring gear 22 are fully engaged, the balls 46 are aligned with and seated in the openings 44, as shown in FIG. 3A. Thus, the balls and openings constitute a centrifugal latch for holding the drive sleeve 24 in its advanced position, as will be discussed in greater detail subsequently. The drive sleeve 24 is provided with a brake member in the form of an annular flange 48 which carries an annular brake plate 52 for a purpose which will be discussed in connection with the brake 32.

The overrunning clutch 28 comprises a driving clutch member 62 and a driven clutch member 64 coupled by drive rollers 66 which provide one-way torque transmission therebetween in a known manner. The driving clutch member 62 is drivingly connected with the drive sleeve 24 by by means such as welding. The driven clutch member 64 is suitably unitary with the pinion 18 and is rotatably mounted on the shaft 16.

The brake 32 is adapted to restrain the starter drive 10 against rotation during the advancing movement of the pinion 18 toward ring gear 22. The brake 32 is provided with disabling means 72 for preventing engagement of the brake while the motor is slowing down, as will be discussed subsequently. The brake 32 comprises a brake member 74 in the form of an annular channel 76 of magnetic material such as soft iron. The brake member 74 includes a brake applying or engaging means in the form of an annular permanent magnet 78, preferably a ceramic magnet. The magnet 78 is disposed within the channel 76 and is polarized in the axial direction. The magnet is potted in place with epoxy resin with the inner pole face seated against the bottom of channel 76 and the outer pole face being flush with the free edges of the channel. Thus, the free edges of the channel 76 constitute magnetic pole pieces of the same polarity and also constitute brake shoes 77 adapted to engage the friction plate 52. The brake member 74 is supported on the starter housing 14 by a suspension which permits axial motion but prevents rotative motion. The suspension comprises a ring 82 of spring metal formed with a set of four spring fingers 84 each of which has one end unitary with the ring 82. The ring is mounted a suitable distance from and affixed to the motor housing by appropriate means such as spacers 86 and screws 88. Each spring finger extends in a circumferential direction and, in its free or relaxed state, lies in the plane of the disk 82. The free end of each spring finger 84 is secured as by welding, to the channel 76. The spring fingers 84 are resilient in the axial direction and by applying force to the channel 76 can be pulled outwardly from the disk 82 and will return toward the plane of the disk when released. The spring fingers 84 also prevent substantial rotation of the brake member 74.

The brake disabling means 72 comprises an electromagnet 92 of annular configuration which is mounted on the starter housing 14 in alignment with the annular channel 76. The electromagnet 92 is energized when the starter motor 12 is turned off. The stopping of the motor causes retraction of the drive sleeve 24. If the brake 32 were engaged during retraction of the drive sleeve 24 the braking action thereon would cause the sleeve to be advanced toward reengagement of the pinion. This undesirable action is avoided by energization of the electromagnet 92 which acts on the brake member 74 and pulls it to a retracted position with the channel 76 seated on the electromagnet 92. In this retracted position of the brake member 74, the brake shoes 77 on channel 76 are out of engagement with the brake plate 52 and thus the brake 32 is inoperative. The electromagnet 92 is connected for energization in the dynamic braking circuit of the starter motor 12, as will be described presently.

Figure 7:
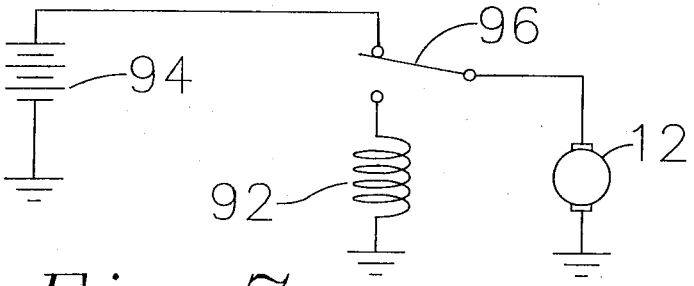
FIG. 7 is a schematic diagram of the starter drive circuit.

The starter motor 12, as described above, is a DC motor with a permanent magnet field. As shown in FIG. 7, the motor 12 is energized from a battery 94 which is the storage battery of the automobile. A starter switch 96 is connected between the battery and the motor. The switch 96 is a single pole double throw switch with its upper fixed contact connected to the battery and its lower fixed contact connected to the electromagnet 92. The movable contact of the switch 96 is connected with the starter motor 12 and is normally in the lower position. When the switch 96 is closed against the upper fixed contact, the starter motor 12 is energized to start the engine. When starting is achieved, the switch 96 is released to engage the lower fixed contact and thus the armature of the motor 12 is connected across the electromagnet 92. In this condition, the motor 12 acts as a generator while the armature continues to rotate and thus the motor is dynamically braked. During the period in which the motor is slowing down, the electromagnet 92 is energized with an initially high current which diminishes with the speed of the armature. This provides sufficient energization of the electromagnet 92 so that the brake member 74 is attracted thereby to its retracted position and is held in the retracted position until the motor comes to a stop.

The operation of the starting system is as follows. When the starter switch 96 is turned on, i.e. closed against the upper fixed contact, the motor 12 will be energized and the shaft 16 will accelerate. The camming action of the roller cam 42 in the slot 38 causes the drive sleeve 24 to advance and move the pinion 18 toward engagement with the ring gear 22. During this action, the brake 32 is engaged and the brake member 74 will follow advancing movement of the drive sleeve 24 until the brake shoes 77 of the channel 76 separate from the brake plate 52 at a predetermined distance of travel. This travel is preferably limited by a stop ring 33 which engages brake 32. The travel may also be limited by designing the fingers 84 so that the stress required to bend the fingers reaches a value which exceeds the attracting force of the permanent magnet at the release point. The predetermined travel of the brake member 74 is that which corresponds to less than full engagement of the pinion 18 with the ring gear 22. Brake 32 prevents rotation of the drive sleeve 24 and thus reduces the reliance on inertia during engagement and allows the use of a starter drive with lower inertia and permits the use of a helical cam of steeper pitch. The stepper pitch and the lack of rotation of the pinion during advancement reduces the rate of rotation of the motor before pinion 18 reaches full engagement with the ring gear 22 and thus diminishes the impact stress upon engagement. In normal engagement of the gears, the brake member 74 will return to its rest position upon separation from the drive sleeve 24. In the event that a pinion tooth abuts a ring gear tooth during engagement, the advancing movement of the drive sleeve 24 stops and rotation thereof commences in spite of the resistance of the brake 32. As soon as the abutted pinion tooth passes the ring gear tooth the advancement of the pinion will proceed to full engagement of the gears. In the event that the starter is turned on while the engine is running, the starter drive 10 will advance until the pinion 18 engages the ring gear 22. The vibration resulting from the contact may disengage the brake 32 and allow the brake member 74 to return to its rest position. In this case, the motor will continue to accelerate if the power continues to be applied and the acceleration will cause the pinion 18 to be urged toward the ring gear 22 but with less force than if the brake were engaged. In this circumstance, the pinion gear may engage the ring gear; otherwise the acceleration will continue until the motor approaches full speed. If the vibration resulting from the contact of the gears does not cause the brake 32 to disengage then the pinion will be pressed into contact with the ring gear as happens with present solenoid actuated systems.

When the starter drive 10 advances the pinion 18 into normal engagement with the ring gear 22, as described above, the centrifugal force on the balls 46 seats them in the openings 44, respectively, when full engagement of the gears is achieved. When the starter motor is operating at low speed and the engine catches, i.e. momentarily starts but does not continue running, the overrunning clutch 28 will drag and the force of the roller cams 42 on the cam slots 38 will urge the drive unit 10 to retract and disengage the gears. However, at low speeds the starter motor will rapidly accelerate and the inertia of the drive will exceed the drag of the overrunning clutch and the gears will remain engaged. If the engine catches when the gears are engaged and the motor is operating at higher speed, the acceleration capability of the motor is diminished. However, the centrifugal latch comprising the balls 46 will be seated with sufficient centrifugal force in the openings 44 so that the combination thereof with the inertial forces will cause the gears to remain engaged. If the engine catches at yet higher speeds, the centrifugal latch alone will provide the forces required to keep the gears engaged.

When the engine is started and the starter motor is turned off by the switch 96, the armature of the starter motor is thereby connected across the electromagnet 92 to effect dynamic braking. If the motor is not rotating at high speed, the deceleration thereof will overcome the forces of the centrifugal latching by the balls 46. Since the deceleration due to dynamic braking decreases in proportion to the motor speed while the centrifugal force on the balls 46 decreases as the square of the speed so that latching is relatively negligible at lower speeds and the gears will easily disengage. At the highest speed, the latching force may be so great that the deceleration forces do not cause the balls 46 to release. In that case, the dynamic braking will reduce the speed in a fraction of a second to the point where the centrifugal latch does release.

When the starter switch is turned off and the motor decelerates under the influence of dynamic braking, the starter drive 10 moves quickly to its retracted position as a result of the forces produced by the roller cams 42 and cam slots 38. If the brake 32 were to become engaged before the motor has stopped, the starter drive 10 might be caused to decelerate more rapidly than the motor. If this should happen, the motor would turn faster than the starter drive and the drive would be moved toward engagement of the pinion gear with the ring gear. This action is undesirable and is prevented by disabling of the brake 32 by the electromagnet 92. In particular, when the motor 12 is turned off and dynamically braked, the initial surge of current through the electromagnet 92 causes it to draw the permanent magnet ring toward itself to the retracted position. The surge of current will diminish as the motor slows down but continues to keep the permanent magnet ring retracted until about the time the motor stops. In this retracted position, there is a space between the brake shoes 77 on the brake member 74 and the brake plate 52 on the brake member 48, as described above, and the brake 32 is disengaged. When the motor comes to a stop the brake member 74 is released by the electromagnet 92 and the brake member 74 returns to its rest position and engages the brake member 48 and the starter drive 10 is thereby held against movement by vibrations and the like which might cause the pinion gear 18 to contact the ring gear 22.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. In a system for starting an internal combustion engine including an electric motor and a starter drive, said drive including:

a driving member rotatable about an axis, a driven member rotatable about the same axis, means for advancing said driven member axially along said axis when the rotative speed of said driving member is greater than the rotative speed of said driven member and for retracting said driven member axially along said axis when the rotative speed of said driving member is less than the rotative speed of said driven member, the improvement comprising:

a brake for restraining said driven member against rotation, a force exerting means acting through a coupling on said driven member for resisting movement of said driven member away from the retracted position when the motor is not operating and also acting through said coupling on said brake for applying said brake during advancing movement of said driven member.

2. In a system for starting an internal combustion engine including an electric motor and a starter drive, said drive including:

a driving member rotatable about an axis, a driven member rotatable about the same axis, means for advancing said driven member axially along said axis toward an engaged position when the rotative speed of said driving member is greater than the rotative speed of said driven member and for retracting said driven member axially along said axis toward a retracted position when the rotative speed of said driving member is less than the rotative speed of said driven member, the improvement comprising:

a brake for resisting said driven member against rotation, a force exerting means coupled with said driven member for urging it toward the retracted position, said force exerting means also coupled with said brake for applying said brake.

3. The invention as defined in claim 2 including means preventing engagement of said brake when said motor is being stopped.

4. The invention as defined in claim 2 wherein said motor has a permanent magnet field.

5. The invention as defined in claim 2 wherein said force exerting means comprises a permanent magnet.

6. The invention as defined in claim 2 wherein said brake comprises a rotatable brake member on said driven member and a nonrotatable brake member, said nonrotatable brake member being axially movable whereby said brake members remain in engagement during axial movement of said driven member.

7. The invention as defined in claim 6 including a plurality of resilient fingers, one end of each finger being connected with a fixed support member and the other end of each finger being connected with said nonrotatable brake member.

8. The invention as defined in claim 6 including means for preventing engagement of said brake when said motor is being stopped.

9. The invention as defined in claim 8 wherein said means for preventing engagement comprises an electromagnet for retracting said nonrotatable brake member to prevent engagement thereof with said rotatable brake member.

10. The invention as defined in claim 9 including switching means for connecting said electromagnet across the armature of said motor when said motor is turned off to thereby dynamically brake said motor and provide energization for said electromagnet while said motor rotates.

11. The invention as defined in claim 9 including stop means for limiting the retracting movement of said driven member to a position in which said nonrotatable brake member is out of engagement with said rotatable brake member when said nonrotatable brake member is being retracted by said electromagnet.

12. The invention as defined in claim 2 wherein said means for advancing comprises camming means.

13. The invention as defined in claim 12 wherein said driven member includes a cylindrical sleeve and said camming means comprises a helical slot in said cylindrical sleeve and a drive pin in said driving member and extending into said slot.

14. The invention as defined in claim 2 including centrifugally actuated latch means for retaining said driven member in its advanced position.

15. The invention as defined in claim 2 including a carrier mounted on said driving member for rotation therewith, a detent element disposed in said carrier for reciprocable movement in a radial direction, and an opening in said driven member in alignment with said detent element when said driven member is in its advanced position for latching engagement of said driven member with said detent element.

16. In a system for starting an internal combustion engine including an electric motor and a starter drive, said drive including:

a driving member rotatable about an axis, a driven member rotatable about the same means for advancing said driven member axially along said axis toward an engaged position when the rotative speed of said driving member is greater than the rotative speed of said driven member and for retracting said driven member axially along said axis toward a retracted position when the rotative speed of said driving member is less than the rotative speed of said driven member, the improvement comprising:

a brake for resisting said driven member against rotation, magnetic means for urging said driven member toward said retracted position and for applying said brake.

17. The invention as defined in claim 16 including means preventing engagement of said brake when said motor is being stopped.

18. The invention as defined in claim 16 wherein said motor has a permanent magnet field.

19. The invention as defined in claim 16 wherein said magnetic means comprises a permanent magnet.

20. The invention as defined in claim 16 wherein said brake comprises a rotatable brake member on said driven member and a nonrotatable brake member, said nonrotatable brake member being axially movable whereby said brake members remain in engagement during axial movement of said driven member.

21. The invention as defined in claim 20 including a plurality of resilient fingers, one end of each finger being connected with a fixed support member and the other end of each finger being connected with said nonrotatable brake member.

22. The invention as defined in claim 20 including means for preventing engagement of said brake when said motor is being stopped.

23. The invention as defined in claim 22 wherein said means for preventing engagement comprises an electromagnet for retracting said nonrotatable brake member to prevent engagement thereof with said rotatable brake member.

24. The invention as defined in claim 23 including switching means for connecting said electromagnet across the armature of said motor when said motor is turned off to thereby dynamically brake said motor and provide energization for said electromagnet while said motor rotates.

25. The invention as defined in claim 23 including stop means for limiting the retracting movement of said driven member to a position in which said nonrotatable brake member is out of engagement with said rotatable brake member when said nonrotatable brake member is being retracted by said electromagnet.

26. The invention as defined in claim 16 wherein said means for advancing comprises camming means.

27. The invention as defined in claim 26 wherein said driven member includes a cylindrical sleeve and said camming means comprises a helical slot in said cylindrical sleeve and a drive pin in said driving member and extending into said slot.

28. The invention as defined in claim 16 including centrifugally actuated latch means for retaining said driven member in its advanced position.

29. The invention as defined in claim 16 including a carrier mounted on said driving member for rotation therewith, a detent element disposed in said carrier for reciprocable movement in a radial direction, and an opening in said driven member in alignment with said detent element when said driven member is in its advanced position for latching engagement of said driven member with said detent element.

* * * * *